United States Patent [19]

Firey

[11] Patent Number: 5,002,024

[45] Date of Patent: Mar. 26, 1991

[54] STARTING MEANS FOR CHAR BURNING ENGINES

[76] Inventor: Joseph C. Firey, P.O. Box 15514, Seattle, Wash. 98115-0514

[21] Appl. No.: 471,599

[22] Filed: Jan. 29, 1990

[51] Int. Cl.[5] ..... F02N 17/02

[52] U.S. Cl. ..... 123/179 H; 123/23

[58] Field of Search ..... 123/179 H, 180 R, 184, 123/23, 24 R, 550

[56] References Cited

U.S. PATENT DOCUMENTS

| | | | |
|---|---|---|---|
| 1,897,819 | 2/1933 | Pawlikowski | 123/23 |
| 2,439,748 | 4/1948 | Nettel | 123/179 H |
| 4,372,256 | 2/1983 | Firey | 123/179 H |
| 4,412,511 | 11/1983 | Firey | 123/23 |

OTHER PUBLICATIONS

"International Diesel Engines, Their Origin and Development", D. B. Baker, SAE paper, Feb. 11, 1947.

"The Elimination of Combustion Knock-Texaco Combustion Process", E. M. Barker, B. Reynolds, W. T. Tierney, SAE Paper, No. 473, Jun. 1950.

"A New Concept of Stratified Charge Combustion-The Ford Combustion Process", I. N. Bishop, A. Simko, SAE Paper 680041, Jan. 1968.

*Primary Examiner*—Andrew M. Dolinar

[57] ABSTRACT

An improved means for starting char burning engines is described wherein, during engine cranking for starting; compressed air is heated burning with a liquid fuel and is then compressed into the pore spaces of the char fuel in order to increase the char fuel temeprature to where it reacts rapidly with air.

10 Claims, 5 Drawing Sheets

STARTING MEANS FOR CHAR BURNING ENGINES

Cross References to Related Applications

The inventions described herein are useable on the inventions described in my earlier filed U.S. Patent Application entitled "Multiple Flow Passages With Differing Connection Places For Cyclic Solid With Gas Reactors", Ser. No 07/275360, filed Nov. 23, 1988. The invention described herein was previously described in my Disclosure Document entitled "Improved Starting Means For Char Burning Engines".

BACKGROUND OF THE INVENTION

1. Field of the invention

This invention is in the field of internal combustion engines and particularly the field of internal combustion engines burning solid fuels alone or in combination with liquid or gaseous fuels.

2. Description of the Prior Art

Relevant Prior Art is described in the following U S Patents issued to applicant:

U.S. Pat. No. 4372256, Feb. 8, 1983
U.S. Pat. No. 4412511, Nov. 1, 1983
U.S. Pat. No. 4698069, Oct. 6, 1987
U.S. Pat. No. 4794729, Jan. 3, 1989

Char burning engines are described in these patents wherein char fuel, contained within a char fuel reaction chamber, is cyclically compressed with air followed by expansion of the product gases resulting from reaction of char fuel with compressed air. Most char fuels will react appreciably with the oxygen gas in the compressed air only when at a sufficiently high temperature, of the order of 900° F. to 1000° F. Most char fuels will react rapidly with the oxygen gas in the compressed air only when at a higher temperature of the order of 1200° F. to 1800° F. thus to start such char BACKGROUND OF THE INVENTION burning engines requires heating char fuel within the char fuel reaction chamber, first to that temperature at which it will react appreciably with oxygen gas, and secondly to that higher temperature at which it will react rapidly with oxygen gas while the engine is being cranked for starting The engine will be fully started only when a sufficient portion of the char fuel is at its rapid reaction temperature that the net work of the cycle of compression followed by expansion on char fuel alone at least equals the friction work of the internal combustion engine mechanism and the engine is then capable of cranking itself Various methods of starting a char burning engine are described in U.S. Pat. No. 4412511, column 4, line 65, through column 5, line 2, and column 35, line 36, through column 37, line 29, and this material is incorporated herein by reference thereto Among other starting methods a diesel engine starting method is described wherein the engine is equipped to start as a conventional diesel engine During the pressure rise caused by burning of the diesel fuel, hot oxygen will be forced into the pores of the char fuel to heat it up and eventually start the char burning rapidly. When the char is capable of rapid burning, the diesel fuel can be turned off and the engine then run on the char fuel With this diesel engine starting method the liquid fuel is necessarily injected later during the engine compression process so that it can be compression ignited As a result the time duration of flow of hot oxygen containing gas into the pores of the char fuel is short, being about equal to the time duration of diesel fuel combustion with pressure rise which is only a few degrees of crankshaft turning angle. Hence heatup of the char fuel is slow since only a portion of the gas compressed therein has been heated by diesel fuel combustion. As a result prolonged cranking is required before the char burning engine can be started running on char fuel. It would be desirable to have a char burning engine starting method which more quickly heated the char fuel to its rapid burning temperature.

Examples of char burning engines are described in general in U.S. Pat. No. 4412511, column 7, line 21 through column 11, line 45, and this material is incorporated herein by reference thereto Such char burning engines comprise a char fuel reaction chamber into which char fuel is placed by a refuel mechanism via a refuel end and from which ashes are removed by an ash removal mechanism via an ash removal end and the char fuel reacts with oxygen in adjacent compressed gases within this char fuel reaction chamber.

The terms, internal combustion engine, and, internal combustion engine mechanism, are used herein and in the claims as defined in U.S. Pat. No. 4,412,511, column 1, line 65 through column 2, line 45. and this material is incorporated herein by reference thereto.

In some internal combustion engine mechanisms a reciprocating piston is operated within a cylinder as a combined means for compressing and expanding the gases, and the space enclosed by the piston crown and the cylinder walls is frequently also a reaction chamber wherein secondary reactions may occur during expansion. In this case the volume of this secondary reaction chamber varies cyclically and is a portion of the combined means for cyclically compressing and expanding gases. For multicylinder internal combustion mechanisms several combined means for compressing and expanding are joined together.

When such combined means for compressing and expanding the gases are used, each compression process occurs over a compression time interval during which the variable volume chamber decreases in volume and this is immediately followed by an expansion process occurring over an expansion time interval during which the variable volume chamber increases in volume.

For Piston and cylinder mechanisms a crank and connecting rod or equivalent mechanism, is used as a drive means for driving the internal combustion engine mechanism and the combined compressing and expanding means portion thereof through repeated cycles of compression followed by expansion Various kinds of drive means and variable volume chamber means for compressing and expanding gases can be used such as the Wankel mechanism and the free piston mechanism as described, for example, in U.S. Pat. No. 4372256.

The term, oxygen gas, is used herein and in the claims as defined in U.S. Pat. No. 4509957, column 3, line 1 through line 8, and this material is incorporated herein by reference thereto.

The term, char fuel, is used herein and in the claims as defined in U.S. Pat. No. 4412511, column 2, line 46 through line 66, and this material is incorporated herein by reference thereto.

The term, changeable gas flow connection, is used herein and in the claims to mean gas flow passages which can be opened or closed while the engine is running or being cranked for starting. The term, fixed open gas flow connection is used herein and in the claims to mean gas flow passages which remain open whenever the engine is running or being cranked for starting.

SUMMARY OF THE INVENTION

Improved apparatus for starting char burning engines is described wherein essentially all of the air being compressed into the char fuel pore spaces during early cranking is heated by being burned with an atomized spray of liquid fuel. The char fuel is thusly heated more quickly to its rapid burning temperature than when a conventional diesel engine starting scheme is used wherein only a portion of this air is heated by burning with liquid fuel. In this way a char burning engine can be quickly started and thus is the principal beneficial object of this invention.

In some forms of this invention liquid fuel burning rate is reduced during later cranking in order to supply more oxygen gas to the char fuel The resulting char fuel oxidation then supplies its heat of reaction to the char fuel heatingprocess.

BRIEF DESCRIPTION OF THE DRAWINGS

One form of the invention is shown in cross section in FIG. 1 wherein the variable volume chamber and the starting reaction chamber are combined.

An example of a liquid fuel pumping means is shown in cross section in FIG. 2.

Figure 3:
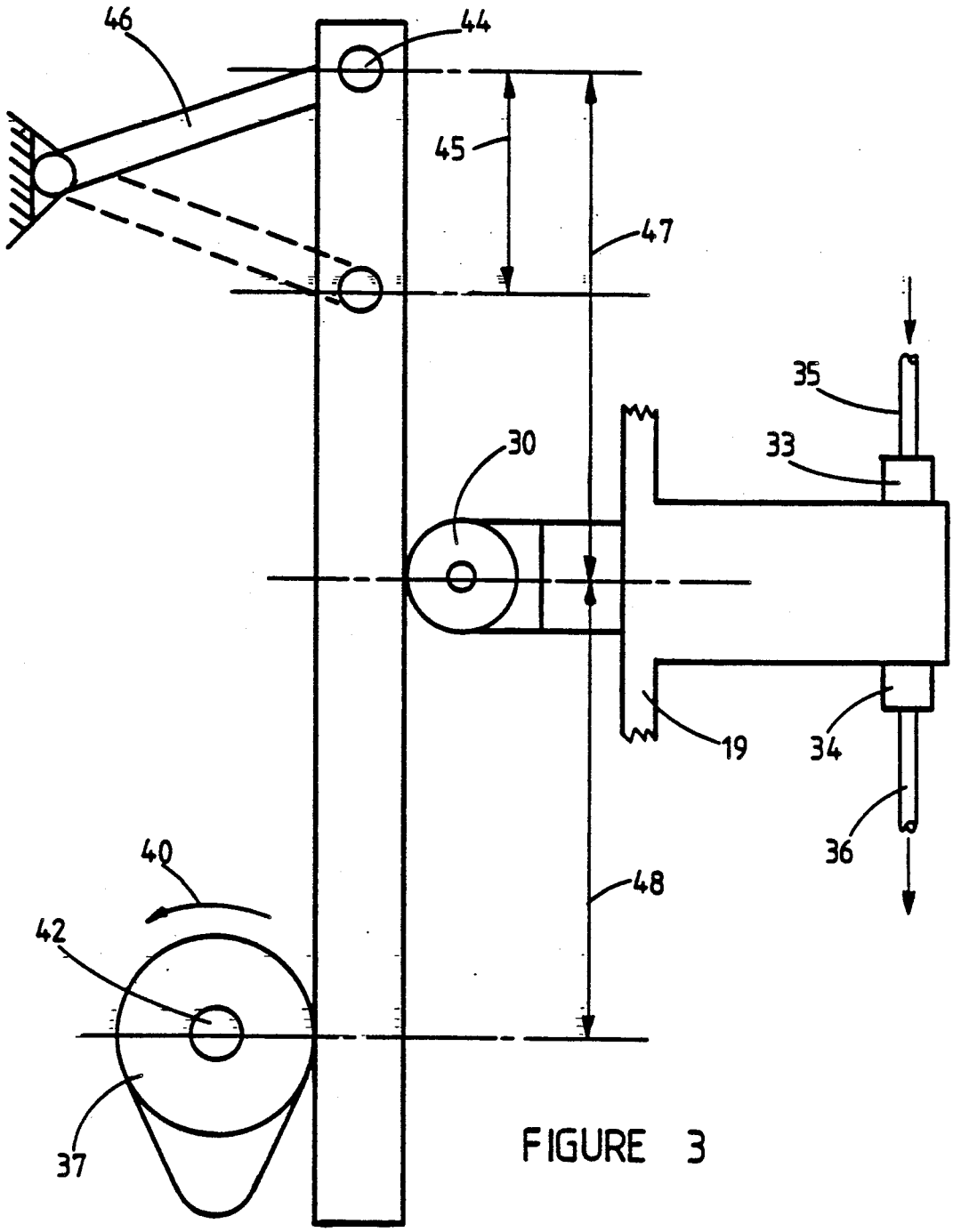

A scheme for varying the liquid fuel quantity being pumped is shown in FIG. 3.

Figure 4:
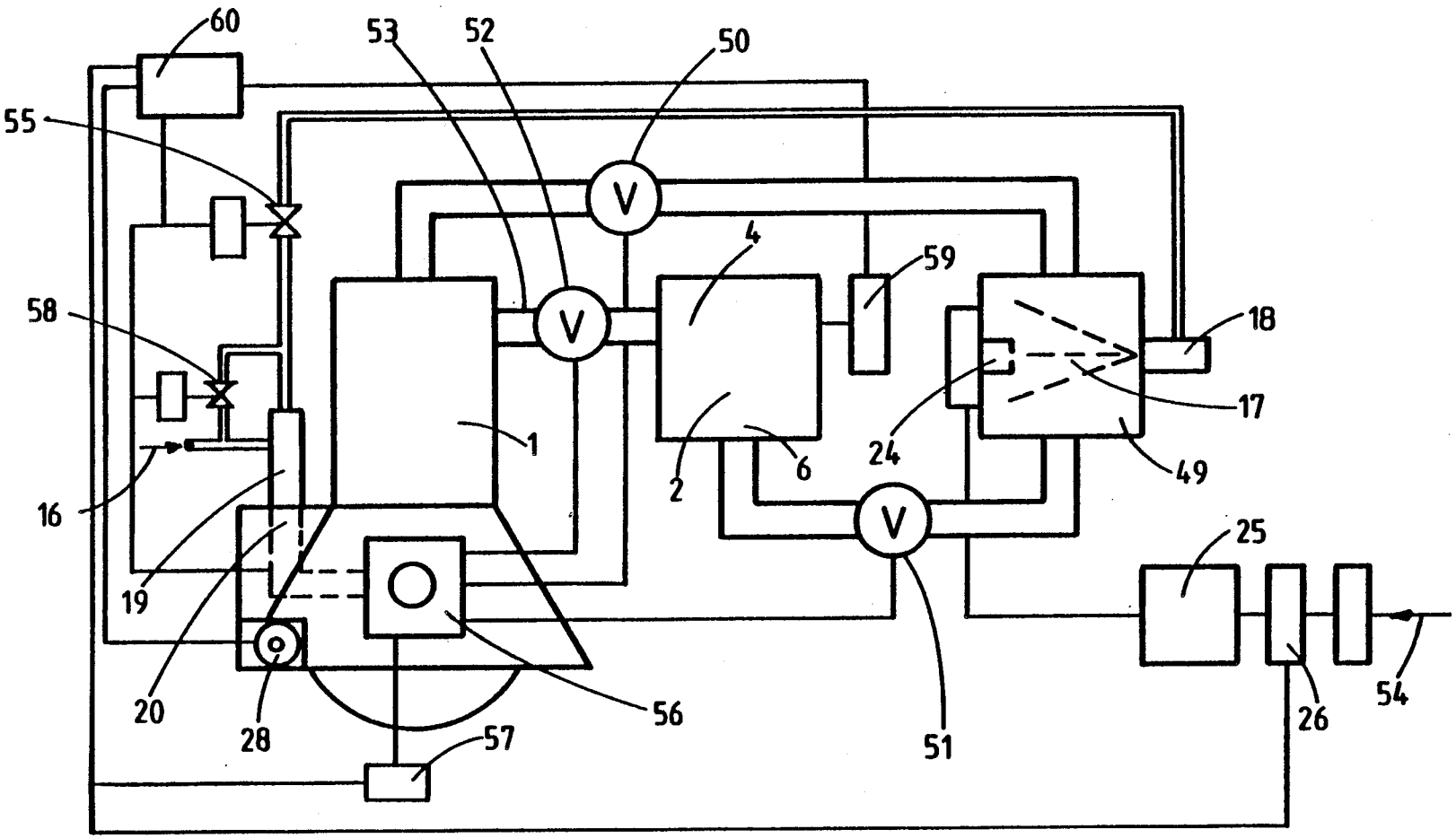

Another form of the invention is shown schematically in FIG. 4, wherein the starting reaction chamber is separate from the variable volume chamber and can be disconnected after the engine has started.

Figure 5:
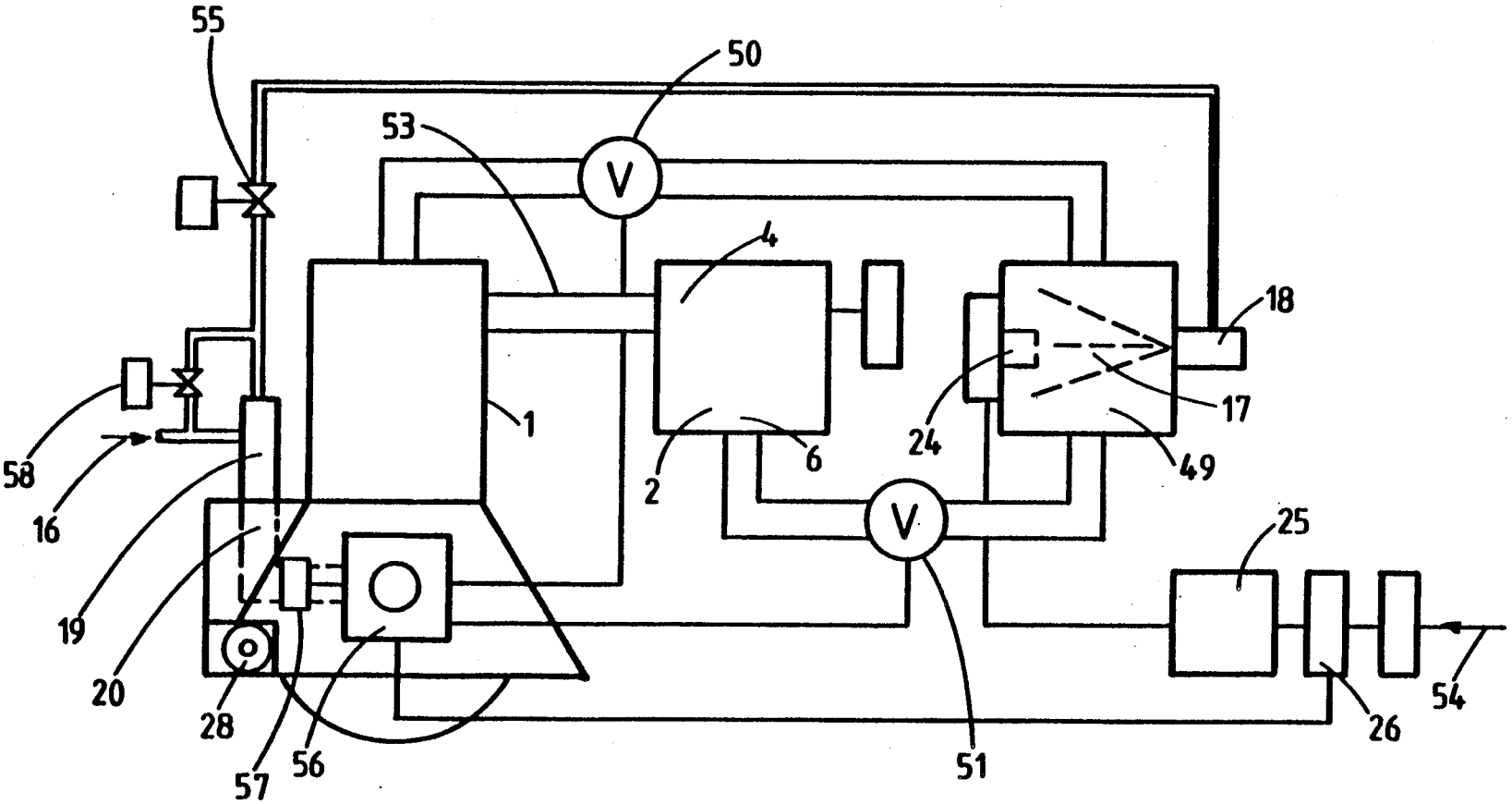

Another form of the invention is shown schematically in FIG. 5, which is similar to the FIG. 4 form except that the char fuel reaction chamber is always open to the variable volume chamber.

DESCRIPTION OF THE PREFERRED EMBODIMENTS

All forms of this invention comprise the following elements:

A. A char burning engine comprising:

1. A char fuel reaction chamber supplied with char fuel by a refuel mechanism via a refuel end thereof and from which ashes can be removed by an ash removal mechanism via the ash removal end thereof;
2. An internal combustion engine mechanism comprising a variable volume chamber portion of a combined means for compressing and expanding gases, and a drive means for driving the internal combustion engine mechanism and for thusly varying the volume of the variable volume chamber through repeated cycles, each such cycle comprising a compression time interval followed by an expansion time interval;
3. A fixed open gas flow connection between the refuel end of the char fuel reaction chamber and the variable volume chamber In some forms of this invention, using a separate starting reaction chamber, this fixed open gas flow connection is modified into a changeable gas flow connection B. A starting reaction chamber. This can be simply that portion of the variable volume chamber located adjacent to the fixed open gas flow connection to the refuel end of the char fuel reaction chamber. Alternatively this starting reaction chamber can be separate and connectable, via changeable gas flow connections to the variable volume chamber and separately to the char fuel reaction chamber.

C. A starting liquid fuel supply source. In principal any liquid fuel capable of burning with air can be used. Liquid fuels of moderate viscosity and fairly high vapor pressure, such as conventional diesel engine fuels, are preferred.

D. A means for injecting the liquid fuel into the starting reaction chamber as an atomized spray during each compression time interval while the engine is being cranked for starting This liquid fuel injector means comprises: a nozzle for creating an atomized spray of liquid fuel droplets inside the starting reaction chamber; a pump to pump liquid fuel from the source to the nozzle; a pump actuator means to drive the pump to pump fuel only during each compression time interval and, at least initially, throughout essentially all of each compression time interval, and driven in turn by the drive means of the internal combustion engine mechanism; a liquid fuel shut off means for opening and for stopping the flow of liquid fuel to the spray nozzle.

E. An ignition means for igniting the atomized liquid fuel spray within the starting reaction chamber. Preferably a continuous electric spark can be used as this ignition means though alternative igniters, such as gas fired pilot flames, can be used The ignition means is equipped with a shut off means to turn off the ignition when liquid fuel is shut off from the starting reaction chamber F. A cranking means for cranking the internal combustion engine mechanism when the engine is to be started This cranking actuates the engine mechanism drive means and thus varies the volume of the variable volume chamber through repeated cycles and actuates the pump actuator so that liquid fuel is injected into the starting reaction chamber. During engine startup cranking will be needed through a warmup time interval during which the char fuel in the char fuel reaction chamber is heated up to a temperature at which it reacts appreciably with oxygen gas in adjacent compressed gases Thereafter cranking is continued through a heatup time interval during which the char fuel temperature is increased to its rapid reaction temperature with oxygen gas Cranking is further continued thereafter through a startup time interval during which the portion of the char fuel within the char fuel reaction chamber which has reached its rapid reaction temperature is increased to the point where the net cycle work due to char fuel reaction alone is sufficient to overcome engine friction and the engine is capable of cranking itself Thereafter the cranking means is turned off. Preferably the starting liquid fuel is injected into the starting reaction chamber only during the warmup time interval and the heatup time interval Any of the various kinds of cranking means used for conventional internal combustion engines can be used as the cranking means for this invention.

Operation of a char burning engine, equipped with the starting apparatus of this invention, is as follows during starting:

I. Liquid fuel flow and ignition are turned on and cranking is started.

II. During early cranking, liquid fuel is injected into the air inside of the starting reaction chamber, during essentially all of each compression time interval, and the atomized liquid fuel spray is ignited by the ignition means.

III. The starting liquid fuel is thusly burned with essentially all of those air portions which are being compressed into the pore spaces of the char fuel in the char fuel reaction chamber. These burned gases are thusly appreciably raised in temperature and act to increase the temperature of the char fuel into which they are compressed.

IV. After continued cranking through a warmup time interval the char fuel in the char fuel reaction chamber reaches that temperature at which it can react appreciably with oxygen gas in adjacent compressed gasses. In some forms of this invention the liquid fuel quantity injected into the starting reaction chamber during each compression time interval is thereafter somewhat reduced during a following heatup time interval of continued cranking By thusly reducing the liquid fuel quantity more oxygen gas is made available to react directly with the char fuel in the char fuel reaction chamber Such burning of char fuel directly adds heat of this reaction to the char fuel. In this way the char fuel temperature is increased further to that temperature at which it can react rapidly with oxygen gas in adjacent compressed gases.

V. Following this heatup time interval of cranking the starting liquid fuel flow can be stopped when the burning of char fuel with air in the char fuel reaction chamber accomplishes further heating of the char fuel and particularly an increasing of the portion of char fuel at or above the rapid reaction temperature VI. When a sufficient portion of the char fuel in the char fuel reaction chamber is reacting rapidly with oxygen gas in adjacent compressed air the net work of the cycle of compression and expansion can equal the friction work of the internal combustion engine mechanism and the engine is then capable of cranking itself. Thus following this later startup time interval of final cranking the cranking means can be turned off and the engine is started.

VII. Hand control of the reducing of liquid fuel quantity after the warmup time interval of cranking and shut off of liquid fuel flow after the following heatup time interval of cranking can be used and is mechanically simple. Alternatively a sensing means can be utilized capable of sensing when the char fuel can react appreciably with oxygen gas and subsequently can react rapidly with oxygen gas This sensor can then operate automatically via a control means, to reduce liquid fuel quantity after the warmup time interval and to shut off liquid fuel flow after the heatup time interval.

VIII. It is a principal beneficial object of this invention that essentially all of the gases being compressed into the pore spaces of the char fuel in the char fuel reaction chamber are increased in temperature by being burned with the starting liquid fuel during compression In this way rapid warmup and heatup of the char fuel is accomplished and a quick engine startup is achieved.

Figure 1:
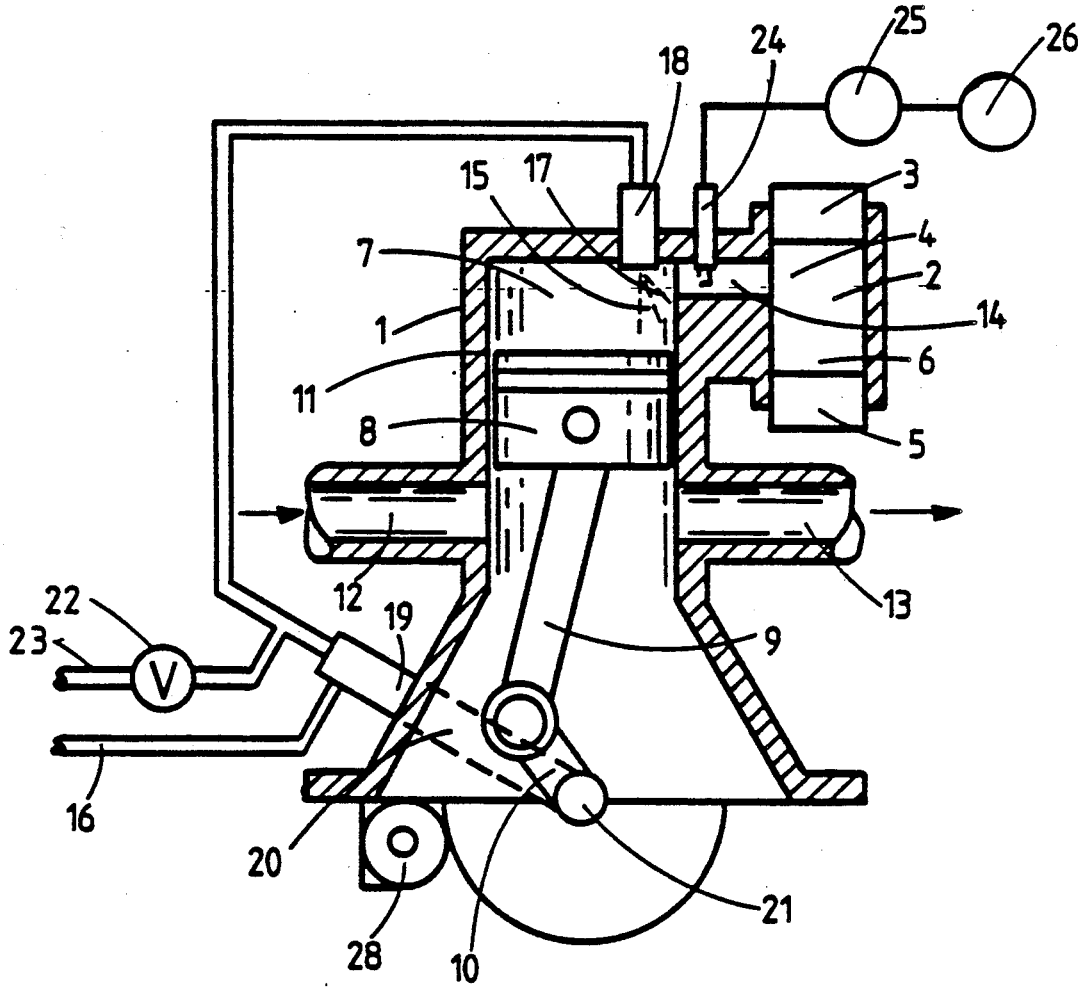

An example of one particular form of this invention is shown schematically in FIG. 1 and comprises the following elements:

A. A char burning engine, 1, comprising:

1. A char fuel reaction chamber, 2, comprising; a refuel mechanism, 3, supplying fuel via the refuel end, 4; an ash removal mechanism, 5, removing ashes via the ash removal end, 6.
2. A two stroke cycle internal combustion engine mechanism comprising a variable volume chamber portion. 7, of the combined means for compressing and expanding which comprises the piston, 8, and cylinder. 11, and the drive means comprising the connecting rod, 9, and crank, 10. A two stroke cycle internal combustion engine mechanism with intake port, 12, and exhaust port 13, is shown in this example of FIG. 1, but a four stroke cycle mechanism can also be used with this invention.
3. A fixed open gas flow connection, 14, between the refuel end, 4, of the char fuel reaction chamber, 2, and the variable volume chamber, 7, of the internal combustion engine mechanism.

B. A starting reaction chamber. 15, which comprises that portion of the variable volume chamber. 7, adjacent to the fixed open gas flow connection, 14, to the refuel end, 4, of the char fuel reaction chamber, 2.

A supply source, 16, for the starting liquid fuel which can connect to a starting fuel tank.

D. A means for injecting the liquid fuel into the starting reaction chamber, 15, as an atomized spray, 17, during each compression time interval following coverage of the ports, 12, and 13, when the piston, 8, is rising and decreasing the volume of the variable volume chamber, 7, while the engine is being cranked for starting, and comprising: a nozzle, 18, for creating the atomized spray, 17, of liquid droplets; a pump, 19, to pump liquid fuel from the source, 16, to the nozzle, 18; a pump actuator means, 20, to drive the pump, 19, to pump fuel only during each compression time interval and, at least initially, throughout essentially all of each compression time interval, and driven from the drive means of the internal combustion engine mechanism, as by a cam on the crankshaft. 21; a liquid fuel shut off means, 22 for opening and for stopping the flow of liquid fuel to the spray nozzle. 18. In the FIG. 1 form of this invention the spray nozzle. 18, is a pressure opening type of nozzle so the shut off means, 22, can be simply a valve which when closed forces fuel to be delivered from the pump, 19, to the spray nozzle. 18, but when open directs all fuel from the pump, 19, to the liquid fuel tank via the return pipe, 23.

E. An ignition means for igniting the atomized liquid spray, 17, in the starting reaction chamber, 15, comprising a spark plug, 24, a continuous spark generator, 25, with internal power source such as a battery, and an on-off switch, 26.

F. A cranking means, 28, for cranking the internal combustion engine mechanism when the engine is to be started. Any of the usual engine cranking means can be used here, such as, an electric motor and battery, a spring motor, a flywheel accumulator motor, a compressed air motor and compressed air supply.

When the char burning engine, 1, of FIG. 1 is to be started, the liquid fuel shut off valve, 22, is closed, the ignition switch, 26, is turned on and the engine is cranked by the cranking means, 28. As the piston. 8, rises during each compression stroke a compression time interval commences when the piston, 8, covers and seals both the intake port, 12, and the exhaust port, 13, and thereafter the pressure in the variable volume chamber, 7, rises since its volume is decreasing. This compression pressure rise causes air to flow from the starting reaction chamber, 15, portion of the variable volume chamber, via the fixed open gas flow connection, 14, into the pore spaces of the char fuel within the char fuel reaction chamber, 2. Concurrently with this compression pressure rise, and hence concurrently with this flow of air from the starting reaction chamber, 15, into the char fuel reaction chamber, 2, liquid fuel is pumped by the pump, 19, to the nozzle, 18, and is atomized in a spray of liquid fuel droplets, 17, within the starting reaction chamber, 15. The continuous spark at the spark plug, 24, ignites this atomized liquid fuel spray in the starting reaction chamber, 15, and the heat of this combustion reaction increases the temperature of these gases as they flow into the pore spaces of the char fuel within the char fuel reaction chamber, 2. This burning of liquid fuel within that air portion about to be compressed into the char fuel pores can occur continuously throughout the compression time interval. In this way essentially all of the gases being compressed into the char fuel pores are heated to a high temperature and in turn heat up the char fuel when they enter the pores thereof When the piston 8 ends a compression stroke at top dead center that compression time interval ends pressure rise due to piston motion ceases, air flow into the char fuel pores via the starting reaction chamber and fixed open gas flow connection stops and the pump, 19, stops pumping liquid fuel to the nozzle, 18.

The foregoing process is repeated during each compression time interval while the char fuel temperature is increasing After a warmup time interval followed by a heatup time interval of such cranking the char fuel in the char fuel reaction chamber, 2 reaches a temperature at which it is capable of reacting rapidly with oxygen gas in adjacent compressed gases At this point the flow of liquid fuel into the starting reaction chamber can be stopped by opening the valve, 22. Thereafter continued cranking during a startup time interval cause air to be compressed into the pore spaces of the char fuel and its reaction there with the hot char fuel acts to directly heat the char fuel. When a sufficient portion of the char fuel in the char fuel reaction chamber is thusly heated to its rapid reaction temperature the net work of the cycle of compression followed by expansion will equal the friction work of the internal combustion engine mechanism. Thereafter the char burning engine is capable of cranking itself and the cranking means, 28 can be turned off since the engine is then started Preferably the rate of injection of liquid fuel into the starting reaction chamber is proportional to the rate of air flow into the starting reaction chamber during the compression time interval and this proportion is somewhat less than the chemically correct, or stoichiometric, proportion. In this preferred way the gases being compressed into the char fuel pores are at a maximum temperature and liquid fuel is not being wasted unburned. This proportion of fuel flow rate to air flow rate is best determined experimentally, inadequate fuel flow rate causing slower char fuel heatup, and excess fuel flow rate creating exhaust smoke.

Figure 2:
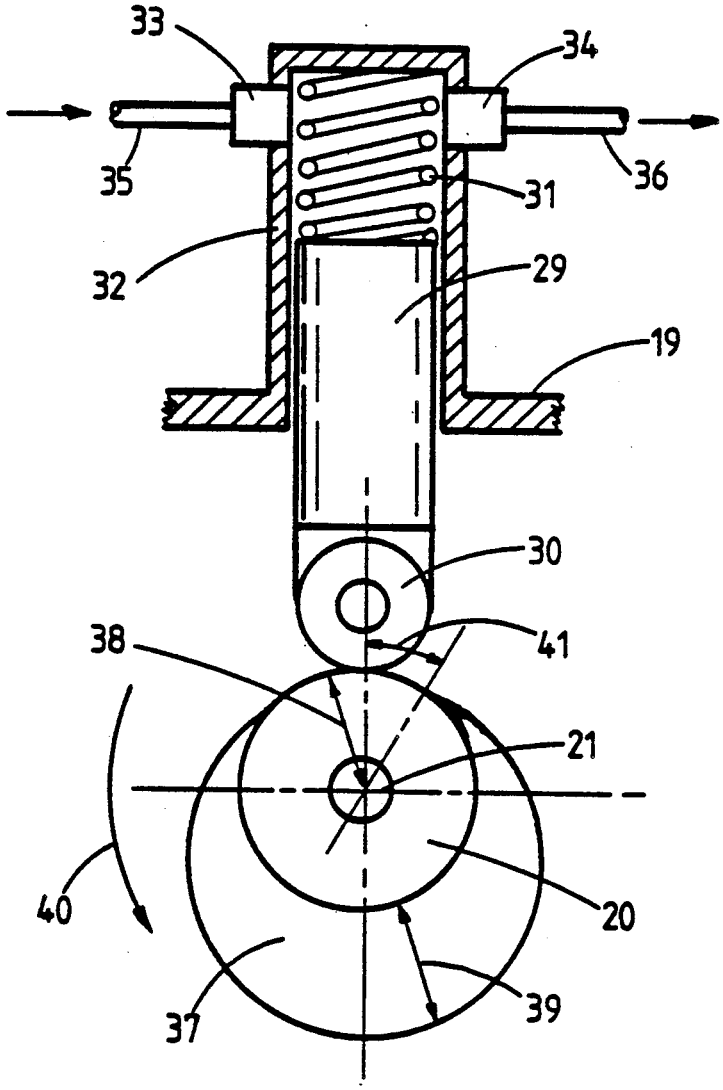

One particular example of a positive displacement liquid fuel pump and actuator means suitable for use with the form of this invention shown in FIG. 1, is shown schematically in FIG. 2 and comprises the following elements:

1. A pump, 19, comprising a plunger, 29, with cam follower, 30, and return spring, 31, operative within a cylinder, 32.
2. A suction check valve, 33, and a delivery check valve, 34, causing liquid fuel to flow from the pump inlet, 35, to the pump outlet, 36, when the plunger, 29, is reciprocated within the cylinder, 32.
3. A pump actuator means, 20, comprising a cam, 37, rotated in the direction, 40, by the engine crankshaft, 21, for a two stroke cycle engine such as shown in FIG. 1. This cam has a constant base circle radius. RB, 38, and a variable added radius portion. DB, 39 For a four stroke cycle engine the cam, 37, is driven by the engine camshaft.

Rotation of the cam. 37, causes upward motion of the plunger. 29 and delivery of a fixed total volume, VF, of liquid fuel out the pump outlet, 36, and to the spray nozzle. 18, during each compression time interval During each next following expansion time interval the plunger. 29 is moved downward by the return spring, 31, and the pump chamber is refilled with liquid fuel from the pump inlet, 35. For a two stroke cycle ported engine as shown in FIG. 1 the compression time interval commences when the intake and exhaust ports, 12, 13, are covered and sealed by the piston, 8, since compression pressure rise then commences We identify a scavenging angle. SA, 41, of crankshaft rotation beyond bottom dead center of the piston. 8, required to thusly cover the ports. 12. 13. The cam. 37, of FIG. 2 is shown in position corresponding to the bottom dead center position of the engine piston. 8, of FIG. 1. Hence the raised portions, 39, of the cam, 37, commence a scavenging angle, SA, 41, of rotation beyond the position shown in FIG. 2.

The following equation gives approximate values for the added radius portion DB, 39, of the liquid fuel pump cam, 37, for an approximately constant proportion between liquid fuel injection rate and air flow rate into the starting reaction chamber during the compression time interval The added radius portion. DB, is here a function of engine crankshaft angle, Y. measured from the piston at top dead center angle position. This equation is useable only during the compression time interval when the ports, 12, 13, are covered and thus only when crank angle, Y, equals or exceeds scavenging angle. SA. The cam, 37, does not have an added radius portion, DB, throughout the scavenging angle, SA, 41, portion of its rotation but has the constant base circle radius, RB. 38.

$$(DB) = 4a\left[\frac{1}{b - \cos CA} - \frac{1}{b+1}\right]$$

$$a = \left[\frac{4}{\pi(df)^2}\right](Z)(FAS)\left(\frac{VSC}{VD}\right)\left(\frac{MA}{2}\right)\left(\frac{1}{gf}\right)$$

$$(CA) = 180 + \left(\frac{180}{180 - SA}\right)(y - 180 - SA)$$

$(SA)$ = scavenging angle, degrees
$y$ = crank angle measured from piston top dead center degrees $$b = \left(\frac{1 + CRS}{CRS - 1}\right)$$

$CRS$ = Volume compression ratio while starting
$(df)$ = liquid fuel pump plunger diameter
$(gf)$ = liquid fuel density
$(FAS)$ = Mass ratio of fuel to air chemically correct mixture
$(Z)$ = Fraction of chemically corect mixture desired in the starting reaction of liquid fuel; usually, $0 < Z < 1.0$
$(MA)$ = Total air mass inside engine cylinder after intake and exhaust are closed
$(VD)$ = Engine displacement volume
$(VSC)$ = Volume into which the starting air mass flows during the compression time interval The starting air mass is that air portion into which the liquid fuel is injected and burned. Hence for the FIG. 1 form of this invention (VSC) is the gas space volume within the char fuel reaction chamber, 2, and the fixed open gas flow connection, 14. Any consistent system of units can be used in this equation.

That portion of the cam, 37, causing retraction of the pump plunger, 29, can be of any reasonable profile, such as a profile symmetrical with that of the fuel delivery portion described above.

For a four stroke cycle internal combustion engine mechanism the cam profile for the liquid fuel pump can be given by the equation presented herein above except for the following changes. The pump cam is rotated at camshaft speed and cam angles are half of the crankshaft angles, y. The scavenging angle, SA, is that crankshaft rotation beyond piston bottom dead center needed for closure of the intake and exhaust valves. The cam does not have an added radius portion throughout the scavenging angle and also throughout the intake stroke and exhaust stroke crank angles but has the constant base circle radius so that no fuel is pumped during these time intervals. Hence the cam for a four stroke cycle engine will differ appreciably from the two stroke cycle engine cam shown in FIG. 2

As the char fuel within the char fuel reaction chamber increases in temperature its rate of reaction with oxygen gas in adjacent compressed gases increases. At room temperature this reaction rate is negligible When the char fuel reaches temperatures of the order of 900° F. to 1000° F. it is capable of reacting at an appreciable rate with oxygen gas. At temperatures of the order of 1200° F. to 1800° F. many char fuels will react rapidly with oxygen gas These appreciable reaction temperatures and rapid reaction temperatures can be different for different char fuels and can also differ at different compression conditions If the flow of starting liquid fuel is reduced when the char fuel reaches the appreciable reaction temperature. More oxygen gas will be available in the gases compressed into the char fuel pores to react with the char fuel. This reaction of the char fuel with oxygen gas directly heats the char fuel by its heat of reaction which is released at the solid surface of the char fuel. In this way we may be able to speed up the engine starting by a more rapid heating of the char fuel due to this direct reaction on the char fuel surface.

Thus, in some forms of this invention, the flow of liquid fuel into the starting reaction chamber is reduced after a warmup period of engine cranking needed to raise the temperature of the char fuel to its appreciable reaction temperature. Thereafter reduced liquid fuel flow and appreciable char reaction are continued during a heatup period of engine cranking needed to raise the temperature of the char fuel to its rapid reaction temperature Following this heatup period of engine cranking the flow of liquid fuel into the starting reaction chamber can be stopped. Additional engine cranking during a startup period may be needed during which the rapid reaction of char fuel with oxygen gas increases the quantity of char fuel capable of this rapid reaction and thus increasing the net work of the engine cycle of compression followed by expansion When this net cycle work equals the friction work of the internal combustion engine mechanism the char burning engine is capable of cranking itself and is started. The cranking means, 28, can then be turned off An example of a liquid fuel pump actuator means suitable for use with at least two different liquid fuel flow rates is shown schematically in FIG. 3 for a four stroke cycle engine and comprises:

1. A pump, 19, similar to the pump means described herein above and with the follower. 30.
2. A cam. 37, rotated in the direction, 40, by the engine camshaft. 42. The profile of this cam can be estimated by the equations presented herein above allowing for the reduced pump motion due to the bar. 43
3. An actuator bar, 43, rotated about its pivot point, 44, by action thereon of the cam, 37, and acting on the follower, 30, to reciprocate the plunger of the pump. 19.
4. The pivot point, 44, can be adjusted over a distance. LA, 45 by moving the lever, 46, as shown in dashed outline in FIG. 3
5. As shown in FIG. 3 the ratio of maximum fuel flow rate, MXF, to minimum fuel flow rate, MNF, can be expressed in terms of the distance. LA, 45, and the distances, LX, 47, and, LY, 48, by the following equation:

$$\frac{MXF}{MNF} = \frac{(LX)}{(LX - LA)}$$

6. At intermediate positions of the bar pivot point 44. fuel flow rate is intermediate between the maximum and minimum flow rates and thus at least two different liquid fuel flow rates can be obtained from the pump and actuator shown in FIG. 3

This liquid fuel pump and actuator means of FIG. 3 can be used for reducing the liquid fuel flow rate during the heatup time interval of cranking below that used during the warmup time interval of cranking as described herein above Such adjustment of liquid fuel flow rate can be done by hand or automatically using sensor means and control means such as are described herein below.

Alternatively the pump and actuator means of FIG. 2 can be fitted with a pressure opened, liquid fuel, bypass to tank, valve on the pump discharge. 36, and an on-off valve on the pipe to this bypass valve When a pressure opened atomizing nozzle is used two different liquid fuel flow rates to the nozzle can be achieved: a higher flow rate when the valve to the bypass valve is closed; and a lower rate when the valve to the bypass valve is opened to bypass a portion of the liquid fuel being delivered by the pump to the fuel tank. The opening pressure for the bypass valve is to be equal to the opening pressure for the atomizing nozzle.

Instead of the mechanical fixed displacement liquid fuel pump means of FIG. 2 a pump means of fixed stroke length but adjustable effective pumping stroke duration can be used, such as the well known Bosch type diesel engine injector pump. A description of such adjustable effective pumping stroke duration pumps is presented in the book, "Fuel Injection And Controls For Internal Combustion Engines", P.G. Burman and F. De Luca, Simons-Boardman Publ., New York, 1962, on page 22 through page 29, and this material is incorporated herein by reference thereto. For the purposes of this invention the effective pumping stroke is to commence at the start of the compression time interval For the warmup time interval of cranking the effective pumping stroke duration is to end at the end of the compression time interval so that liquid fuel is supplied to the starting reaction chamber throughout the warmup time interval of engine cranking For the heatup time interval of cranking the effective pumping stroke duration can be shortened to end before the end of the compression time interval in order to supply gases of high oxygen content to the char fuel during the last portion of the compression time interval Hence with this Bosch type fuel pump means liquid fuel is injected into the starting reaction chamber, starting at the start of each compression time interval, and ending after a fractional portion thereof, with this fractional portion being essentially one during the warmup time interval. and less than one during the heatup time interval of cranking Various types of liquid fuel pump means and pump actuator means can be used as are well known in the art of liquid fuel metering pumps. For example, a piezoelectric pump can be used instead of a mechanical pump, and in this case the actuator would generate a voltage to be applied to the piezoelectric element.

The nozzle for creating the atomized spray of liquid droplets in the starting reaction chamber can be of several different kinds such as injection nozzles as used in diesel engines Descriptions of diesel engine nozzles useable with this invention are presented in the books, "Fuel Injection And Controls For Internal Combustion Engines", by P.G. Burman and F. De Luca, Simmons-Boardman Publ., New York, 1962, on page 5 through page 34, and this material is incorporated herein by reference thereto For char burning engines of small displacement, and thus low liquid fuel flow rates during injection, the nozzle hole sizes may become very small and hence easily clogged For these low flow rate applications an air injection system may be preferred such as are described in the above reference on page 9 through page 17. The required air compressor can be driven conventionally from the engine crankshaft, or alternatively by use of the engine cylinder compressed air acting on a large diameter driven piston which drives in turn a small diameter injection air compressor piston For igniting the atomized spray of liquid fuel in the starting reaction chamber a continuous spark igniter is preferred such as are well known in the art of fuel oil burners. Intermittent spark igniter schemes, such as are used for gasoline engines, can also be used provided the spark is repeated several times throughout each compression time interval. Glow plug igniters are also useable with this invention and have the advantage of freedom from fouling by deposits Other igniters such as pilot flames can also be used as the ignition means for this invention.

Using a portion of the variable volume chamber of the internal combustion engine mechanism as the starting reaction chamber, as shown in FIG. 1 is the simplest scheme. Alternatively a separate starting reaction chamber can be used and this can be disconnected from the engine after the char burning engine is started. One particular example of a separate starting reaction chamber is shown schematically in FIG. 4 and comprises:

A. A char burning engine, 1, which can be similar to that of FIG. 1

B. A separate starting reaction chamber. 49 with a changeable gas flow connection, 50, to the variable volume chamber of the internal combustion engine mechanism, and another changeable gas flow connection, 51, to the ash removal end, 6, of the char fuel reaction chamber, 2.

C. A means for opening and closing, 52 the fixed open gas flow connection, 53, between the refuel end, 4, of the char fuel reaction chamber, 2, and the variable volume chamber of the internal combustion engine mechanism. With this modification this gas flow connection becomes a changeable gas flow connection.

D. A means for injecting liquid fuel into the starting reaction chamber. 49, as an atomized spray, 17, during each compression time interval and comprising: a nozzle, 18; a pump, 19, to pump liquid fuel from a source, 16, to the nozzle, 18; a pump actuator means, 20, to drive the pump, 19, and driven from the drive means of the internal combustion engine mechanism; a liquid fuel shut off means 55, for opening and for stopping the flow of liquid fuel to the spray nozzle, 18. This means for injecting liquid fuel can be essentially similar in description and operation to that of FIG. 1 described herein above.

E. An ignition means for igniting the atomized liquid spray, 17, in the starting reaction chamber, 49, and comprising a spark plug. 24, a continuous spark generator, 25, with external power source. 54, and an on-off switch, 26.

F. A cranking means, 28, for cranking the internal combustion engine mechanism when the engine is to be started.

G. A valve drive means, 56, for opening and closing the several changeable gas flow connections, 50, 51. 52, and comprising an adjustment means. 57, and driven by the drive means of the internal combustion engine mechanism During engine startup cranking warmup time interval and heatup time interval this valve drive means is adjusted to drive so that:

(1.) The char fuel reaction chamber, 2, is closed to the variable volume chamber of the internal combustion engine mechanism during each compression time interval and is open thereto during each expansion time interval;

(2.) The char fuel reaction chamber, 2 is open to the starting reaction chamber. 49, during each compression time interval and also during each expansion time interval, (3.) The starting reaction chamber, 49, is open to the variable volume chamber of the internal combustion engine mechanism during each compression time interval and is closed thereto during each expansion time interval;

During engine cranking after the heatup time interval and whenever the char burning engine is capable of cranking itself this valve drive means is adjusted so that:

(4.) The starting reaction chamber, 49, is closed to both the variable volume chamber of the internal combustion engine mechanism and the char fuel reaction chamber, 2, by closure of the valves, 50, and, 51;

(5.) The char fuel reaction chamber, 2, is open to the variable volume chamber of the internal combustion engine mechanism during both the compression time interval and the expansion time interval by opening the valve. 52

This adjusting of the valve drive means. 56, via the adjustment means, 57, during engine cranking for starting can be done by hand or automatically as described herein below Any valve drive means can be used such as are well known in the art of mechanisms, such as cams and linkages, pneumatic valves and actuators hydraulic valves and actuators, etc.

H. During engine startup cranking warmup time interval and heatup time interval the liquid fuel shut off means, 55, is open to allow pumping of liquid fuel to the spray nozzle, 18. During engine cranking after the heatup time interval and whenever the char burning engine is capable of cranking itself the liquid fuel shut off means 55, is closed to stop pumping of liquid fuel to the spray nozzle 18. Where a positive displacement pump, 19, is used a liquid fuel bypass valve. 58, may be needed to return liquid fuel to the source. 16. This adjustment of the liquid fuel shut off means, 55, during engine cranking for starting can be done by hand or automatically as described herein below.

The char burning engine starting apparatus using changeable gas flow connections as shown in FIG. 4 operates in the same manner as that shown in FIG. 1, as described herein above, expect for the opening and closing of the valves in the several changeable gas flow connections. 50 51 52, and these operate as follows:

1. During engine warmup and heatup cranking valves, 50, and, 51, are open and valve. 52, is closed during each compression time interval. Hence air flows from the variable volume chamber via connection, 50. into the starting reaction chamber, 49, and is there burned with the concurrently injected liquid fuel The resulting hot gases then flow into the char fuel reaction chamber, 2, via connection, 51, and there increase the temperature of the char fuel therein during each compression time interval.
2. During each expansion time interval of engine cranking for warmup and heatup valves, 51, and, 52, are open and valve, 50, is closed Hence hot gases from the starting reaction chamber, 49, and the char fuel reaction chamber, 2, flow through the length of the char fuel reaction chamber, 2, from the ash removal end, 6, to the refuel end, 4, and act therein to further increase the temperature of the char fuel, and then flow into the variable volume chamber via connection. 52.
3. In this way hot gases flow into and over the char fuel in the char reaction chamber, 2, during both the compression time interval and the expansion time interval of each engine cycle during cranking with this FIG. 4 form of the invention.
4. After the cranking heatup time interval, and whenever the engine is capable of cranking itself, valves, 50, and, 51, are closed and valve, 52, is open and the starting reaction chamber, 49, is thus closed off from the variable volume chamber and the char fuel reaction chamber during normal engine running.

While this FIG. 4 form of the invention is more complex than the FIG. 1 form it offers the advantage of a longer time of char fuel heating during each engine cycle of cranking and hence a quicker engine start.

Another example of a separate starting reaction chamber with changeable gas flow connections is shown schematically in FIG. 5. This form of the invention differs from that shown in FIG. 4 in that the gas flow connection, 53, from the variable volume chamber to the char fuel reaction chamber is a fixed open gas flow connection. This FIG. 5 form of the invention is otherwise similar in description and operation to that shown in FIG. 4, as described herein above. except that the flow of air and hot gases during the compression and expansion time intervals differs as follows:

1. During engine warmup and heatup cranking air flows from the variable volume chamber into both the char fuel reaction chamber, 2, and the starting reaction chamber, 49, during the compression time interval.
2. During each expansion time interval of engine warmup and heatup cranking hot gases from the starting reaction chamber, 49, flow through the length of the char fuel reaction chamber, 2, from the ash removal end, 6, to the refuel end, 4, and act therein to increase the temperature of the char fuel, and then flow into the variable volume chamber.

In some applications of char burning engines it will be preferred to automatically make the following adjustments during engine starting:

A. Turning liquid fuel injection on at the commencement of cranking and turning it off at the end of the heatup time interval. Also, where used, reducing the flow of liquid fuel during the heatup time interval;

B. Turning the ignition means on at the commencement of liquid fuel injection and turning it off when liquid fuel flow is stopped;

C. Where a separate starting reaction chamber is used, the adjustment of the valve drive means for changing the changeable gas flow connection, so that these connections are changed during the warmup and heatup time intervals and are fixed when the engine is cranking or running thereafter as described herein above;

For this purpose a sensor means is needed capable of sensing when the char fuel is capable of reacting appreciably with oxygen gas in adjacent compressed gases and also when the char fuel is capable of reacting rapidly therewith. Additionally a control means is needed which responds to the sensor means signal by making the several adjustments outlined herein above. Various types of sensor means and control means can be used for the purposes of this invention.

One particular example automatic sensor means and control means is shown schematically in FIG. 4 and comprises:

1. A temperature sensor means, 59, placed inside the char fuel reaction chamber, 2, to sense the temperature of the char fuel therein. A thermocouple temperature sensor, an optical temperature sensor, an infra-red temperature sensor, or other types of temperature sensors could be used here.
2. The temperature signal created by this sensor, 59, is transmitted to the control means, 60, which is operative upon: the liquid fuel shut off means, 55, and bypass means, 58; the adjustment means, 57, of the valve drive means, 56; the liquid fuel pump actuator means, 20. The control means, 60, is also responsive to the cranking means, 28.
3. When engine cranking commences the control means, 60, opens the liquid fuel shut off means, 55, and closes the bypass means, 58, to allow pumping of liquid fuel from the pump, 19, to the nozzle, 18, and adjusts the valve drive means, 56, so that:
   (i) the char fuel reaction chamber, 2, is open to the starting reaction chamber, 49, by opening the valve, 51, during each compression time interval and each expansion time interval;
   (ii) the starting reaction chamber, 49, is open to the variable volume chamber of the internal combustion engine mechanism during each compression time interval by opening valve. 50, and is closed thereto during each expansion time interval by closing valve, 50;
   (iii) the char fuel reaction chamber, 2, is open to the variable volume chamber of the internal combustion engine mechanism during each expansion time interval by opening the valve, 52, and is closed thereto during each compression time interval by closing the valve, 52;

4. When the warmup time interval of cranking ends and the temperature of the char fuel in the char fuel reaction chamber, 2, reaches its appreciable reaction rate temperature the consequent sensor, 59, signal may act via the control means, 60, to reduce the rate of liquid fuel flow to the nozzle, 18, by adjusting the pump actuator means, 20, or by opening a pressure opened liquid fuel bypass means, 58, or by adjusting the pump means, 19, depending upon the type of means used for injecting liquid fuel into the starting reaction chamber.
5. When the heatup time interval of cranking ends and the temperature of the char fuel in the char fuel reaction chamber, 2, reaches its rapid reaction rate temperature the consequent sensor, 59, signal may act via the control means, 60, to stop the flow of liquid fuel to the nozzle, 18, as by closing the liquid fuel shut off means 55, and opening the liquid fuel bypass means, 58, or by adjusting the pump actuator means, 20, or by adjusting the pump means. 19. At this char fuel temperature the control means, 60 additionally adjusts the valve drive means, 56, so that : the char fuel reaction chamber, 2, is open to the variable volume chamber of the internal combustion engine mechanism during each compression time interval and each expansion time interval by opening valve, 52; the starting reaction chamber, 49, is closed to the char fuel reaction chamber, 2, and the variable volume chamber during each compression time interval and each expansion time interval by closing valve, 50, and valve 51.
6. Preferably the control means, 60, is additionally operative upon the ignition switch, 26, so that ignition is turned on when cranking commences, and is turned off when liquid fuel flow to the nozzle, 18, is stopped.

Various types of control means can be used for the controller, 60, such as an electronic circuit, receiving as input the voltage output of the temperature sensor, 59, and the voltage to the cranking motor, 28, and as output actuating various solenoid piloted pneumatic valves to deliver actuating compressed air to the liquid fuel shut off valve, 55, the pump actuator means, 20, the adjustor, 57, of the valve drive means, 56, and the switch, 26, of the ignition means, 25. Hydraulic or direct solenoid actuation can alternatively be used as is well known in the art of control means an actuator means.

Different char fuels are known to react at different rates with oxygen gas and these reaction rates also differ at different char burning engine operating conditions such as compression ratio and supercharge. Hence the determination of the char fuel appreciable reaction temperature and rapid reaction temperature is best done experimentally in the engine with that char fuel intended for use. The char fuel appreciable reaction temperature can be defined for purposes of this invention as that temperature at which the char fuel temperature in the char fuel reaction chamber, 2, does not decrease when the starting liquid fuel flow to the starting reaction chamber is stopped. The char fuel rapid reaction temperature can be defined for purposes of this invention as that temperature at which the char fuel temperature in the char fuel reaction chamber continues to increase when the starting liquid fuel flow to the starting reaction chamber is stopped.

The automatic sensor and control means shown in FIG. 4 and described herein above can also be used with the FIG. 1 form of this invention by modifying the control means to operate, as described, only on the means for injecting liquid fuel into the starting reaction chamber, and preferably also on the switch for the ignition means.

Having thus described my invention what I claim is:

1. In a char burning engine comprising at least one combined means for compressing and expanding, each said combined means comprising:

a char fuel reaction chamber supplied with a char fuel and comprising a refuel end and an ash removal end; an internal combustion engine mechanism comprising a variable volume chamber portion of a combined means for compressing and expanding gases and drive means for driving said internal combustion engine mechanism and varying the volume of said chamber through repeated cycles, each cycle comprising a compression time interval followed by an expansion time interval; a fixed open gas flow connection between said refuel end of said char fuel reaction chamber and said variable volume chamber of said internal combustion engine mechanism;

an improvement comprising:

modifying said variable volume chambers to comprise a starting reaction chamber portion adjacent to the variable volume chamber end of said fixed open gas flow connection;

and adding to each said combined means for compressing and expanding:

a liquid fuel supply source;

means for injecting liquid fuel into said starting reaction chamber and comprising:

nozzle means for creating an atomized liquid spray inside said starting reaction chamber;

pumping means for pumping liquid fuel from said liquid fuel supply source to said nozzle means;

pump actuator means for actuating said pumping means, and driven by said drive means of said internal combustion engine mechanism, so that liquid fuel is pumped to said nozzle means only during each said compression time interval and throughout essentially all of each said compression time interval of said internal combustion engine mechanism;

liquid shut off means for opening and stopping said pumping of liquid fuel from said liquid fuel supply source to said nozzle means;

means for cranking said internal combustion engine mechanism when said char burning engine is to be started so that said cranking can be continued through a warmup time interval for heating said char fuel to that temperature at which some of it reacts appreciably with oxygen gas in adjacent compressed gas, and said cranking can be continued through a heatup time interval for heating said char fuel to that temperature at which some of it reacts rapidly with oxygen gas in adjacent compressed gas, and said cranking can be continued through a startup time interval for heating a sufficient portion of said char fuel to said rapid reaction temperature so that said char burning engine is capable of cranking itself, and said cranking means can be turned off when said char burning engine is capable of cranking itself;

ignition means for igniting said atomized liquid fuel spray within said starting reaction chamber during each said compression time interval of said internal combustion engine mechanism and comprising means for turning said ignition means on and off.

2. In a charburning engine as described in claim 1 wherein each said combined means for compressing and expanding further comprising sensing means for sensing when char fuel within said char fuel reaction chamber is sufficiently hot to react appreciably with oxygen gas in adjacent compressed gas and also when said char fuel is sufficiently hot to react rapidly with oxygen gas in adjacent compressed gas;

control means, responsive to said cranking means and said sensing means for sensing when char fuel is capable of reacting with oxygen gas, and operative upon said liquid shut off means for stopping said pumping of liquid fuel, so that during engine cranking warmup time interval and heatup time interval, said liquid fuel shut off means is open to allow pumping of liquid fuel to said nozzle means, and so that during engine cranking after said heatup time interval and thereafter when said charburning engine is capable of cranking itself, said liquid fuel shut off means is closed to stop pumping of liquid fuel to said nozzle means 3. In a char and oil burning engine as describe in claim 1 wherein said pump actuator means actuates said pumping means so that liquid fuel is pumped to said nozzle means at a rate proportional to air flow rate into said starting reaction chambers during each said compression time interval, and said proportion of liquid fuel flow rate to said air flow rate is approximately constant.

4. In a char burning engine as described in claim 2 wherein said pump actuator means actuates said pumping means so that liquid fuel is pumped to said nozzle means at a rate proportional to air flow rate into said starting reaction chambers during each said compression time interval.

and said proportion of liquid fuel flow rate to said air flow rate is approximately constant.

5. In a char and oil burning engine as described in claim 2 wherein said pump actuator means actuates said pumping means so that liquid fuel is pumped to said nozzle means at a rate proportional to air flow rate into said starting reaction chambers during each said compression time interval, and further wherein said control means, responsive to said sensing means for sensing when char fuel is capable of reacting with oxygen, is also operative upon said means for injecting liquid fuel so that said proportion of liquid fuel flow rate to said air flow rate has at least two different values, with said proportions having lower values during said heatup time interval of cranking than during said warmup time interval of cranking 6. In a char burning engine comprising at least one combined means for compressing and expanding, each said combined means comprising:

a char fuel reaction chamber supplied with a char fuel and comprising a refuel end and an ash removal end; an internal combustion engine mechanism comprising a variable volume chamber portion of a combined means for compressing and expanding gases and drive means for driving said internal combustion engine mechanism and varying the volume of said chamber through repeated cycles, each cycle comprising a compression time interval followed by an expansion time interval; a fixed open gas flow connection between said refuel end of said char fuel reaction chamber and said variable volume chamber of said internal combustion engine mechanism;

an improvement comprising:

modifying said variable volume chambers to comprise a starting reaction chamber portion adjacent to the variable volume chamber end of said fixed open gas flow connection;

and adding to each said combined means for compressing and expanding:

a liquid fuel supply source;

means for injecting liquid fuel into said starting reaction chamber and comprising:

nozzle means for creating an atomized liquid spray inside said starting reaction chamber;

pumping means for pumping liquid fuel from said liquid fuel supply source to said nozzle means;

pump actuator means for actuating said liquid fuel pumping means and driven by said drive means of said internal combustion engine mechanism so that liquid fuel is pumped to said nozzle means only during each said compression time interval, starting essentially at the starting of said compression time interval and ending after a fractional portion of said compression time interval, said fractional portion not exceeding a value of one;

liquid shut off means for opening and pumping of liquid fuel from said liquid fuel supply source to said nozzle means;

means for cranking said internal combustion engine mechanism when said char and oil burning engine is to be started so that said cranking can be continued through a warmup time interval for heating said char fuel to that temperature at which some of it reacts appreciably with oxygen gas in adjacent compressed gas, and said cranking can be continued through a heatup time interval for heating said char fuel to that temperature at which some of it reacts rapidly with oxygen gas in adjacent compressed gas, and said cranking can be continued through a startup time interval for heating a sufficient portion of said char fuel to said rapid reaction temperature so that said char and oil burning engine is capable of cranking itself, and said cranking means can be turned off when said char and oil burning engine is capable of cranking itself;

ignition means for igniting said atomized liquid fuel spray within said starting reaction chamber during each said compression time interval of said internal combustion engine mechanism and comprising means for turning said ignition means on and off.

7. In a char burning engine as described in claim 6 wherein each said combined means for compressing and expanding further comprising:

sensing means for sensing when char fuel within said char fuel reaction chamber is sufficiently hot to react appreciably with oxygen gas in adjacent compressed gas and also when said char fuel is sufficiently hot to react rapidly with oxygen gas in adjacent compressed gas;

control means, responsive to said cranking means and said sensing means for sensing when char fuel is capable of reacting with oxygen gas, and operative upon said liquid shut off means for stopping said pumping of liquid fuel, so that during engine cranking warmup time interval and heatup time interval, said liquid fuel shut off means is open to allow pumping of liquid fuel to said nozzle means, and so that, during engine cranking after said heatup time interval and thereafter when said char burning engine is capable of cranking itself, said liquid fuel shut off means is closed to stop pumping of liquid fuel to said nozzle means.

8. In a char burning engine as described in claim 5 wherein said pump actuator means actuates said pumping means so that when liquid fuel is pumped to said nozzle means it is pumped at a rate proportional to air flow rate into said starting reaction chambers during each said compression time interval, and said proportion of liquid fuel flow rate to said air flow rate is approximately constant.

9. In a char burning engine as described in claim 7 wherein said pump actuator means actuates said pumping means so that when liquid fuel is pumped to said nozzle means it is pumped at a rate proportional to air flow rate into said starting reaction chambers during each said compression time interval, and said proportion of liquid fuel flow rate to said air flow rate is approximately constant.

10. In a char burning engine as described in claim 9 wherein said control means, responsive to said sensing means for sensing when char fuel is capable of reacting with oxygen, is also operative upon said means for injecting liquid fuel so that said means for injecting liquid fuel injects liquid fuel into said starting reaction chambers so that the fractional portion of said compression time interval during which liquid fuel is pumped to said nozzle means is adjustable over a range of values less than one, said fractional portions being less during said heatup time interval of cranking than during said warmup time interval of cranking.

* * * * *

UNITED STATES PATENT AND TRADEMARK OFFICE

CERTIFICATE OF CORRECTION

PATENT NO. : 5,002,024

DATED : Mar. 26, 1991

INVENTOR(S) : Joseph C. Firey

It is certified that error appears in the above-identified patent and that said Letters Patent is hereby corrected as shown below:

Abstract: line 3, insert, -- by--, between heated and burning;
line 5, delete, "temeprature," and substitute - temperature --.

Col. 1, line 39: delete, "Background of The Invention."
Col. 1, line 60: insert a period after engine.
Col. 1, line 65: insert a period after fuel.

Col. 3, line 62: insert a period after chamber.
Col. 4, line 35; insert a period after started.
Col. 6, line 1: change period after portion to a comma.
Col. 6, line 3: change period after cylinder to a comma.
Col. 6, line 13: change period after chamber to a comma.
Col. 6, line 14: change period after chamber to a comma.
Col. 6, line 33: change period after crankshaft to a comma.
Col. 6, line 35: change period after nozzle to a comma.
Col. 6, line 36: change period after nozzle to a comma.
Col. 6, line 39: change period after nozzle to a comma.
Col. 7, line 16: insert a period after thereof.
Col. 7, line 17: insert a comma after ends.
Col. 7, line 24: insert a period after increasing.
Col. 7, line 28: insert a period after gases.
Col. 8, line 2: change period after radius to a comma.
Col. 8, line 3: change period after portion to a comma.
Col. 8, line 5: change period after cam to a comma.
Col. 8, line 6: change period after plunger to a comma.
Col. 8, line 8: change period after nozzle to a comma.
Col. 8, line 8: insert a period after interval.
Col. 8, line 10: change period after plunger to a comma.
Col. 8, line 17: change period after angle to a comma.
Col. 8, line 18: change period after piston to a comma.
Col. 8, line 19: change period after ports to a comma.
Col. 8, line 19: change period after 12 to a comma.
Col. 8, line 19: change period after cam to a comma.

UNITED STATES PATENT AND TRADEMARK OFFICE

CERTIFICATE OF CORRECTION

PATENT NO. : 5,002,024

DATED : Mar. 26, 1991

INVENTOR(S) : Joseph C. Firey

It is certified that error appears in the above-identified patent and that said Letters Patent is hereby corrected as shown below:

Col. 8, line 21: change period after piston to a comma.
Col. 8, line 30: change period after portion to a comma.
Col. 8, line 31: change period after Y to a comma.
Col. 8, line 35: change period after angle to a comma.
Col. 8, line 38: change period after RB to a comma.
Col. 9, line 29: insert a period after negligible.
Col. 9, line 37: insert a period after conditions.
Col. 9, line 39: change period after temperature to a comma.
Col. 9, line 39: delete, "More " and substitute, -- more --.
Col. 10, line 5: change period after cam to a comma.
Col. 10, line 9: change period after bar to a comma.
Col. 10, line 13: change period after pump to a comma.
Col. 10, line 15: change period after distance to a comma.
Col. 10, line 19: change period after distance to a comma.
Col. 10, line 41: change period after discharge to a comma.
Col. 10, line 42: insert a period before When.
Col. 10, line 63: insert a period after interval.
Col. 10, line 68: insert a period after cranking.
Col. 11, line 5: insert a period after interval.
Col. 11, line 11: change period before and to a comma.
Col. 11, line 12: insert a period after cranking.
Col. 11, line 21: insert a period after engines.
Col. 11, line 27: insert a period after thereto.
Col. 11, line 30: insert a period after clogged.
Col. 11, line 37: insert a period after piston.
Col. 11, line 46: insert a period after deposits.
Col. 11, line 59: change period after chamber to a comma.
Col. 12, line 4: change period after chamber to a comma.
Col. 12, line 17: change period after plug to a comma.
Col. 12, line 18: change period after source to a comma.
Col. 12, line 24: change period after 51 to a comma.
Col. 12, line 25: change period after means to a comma.

UNITED STATES PATENT AND TRADEMARK OFFICE

CERTIFICATE OF CORRECTION

PATENT NO. : 5,002,024

DATED : Mar. 26, 1991

INVENTOR(S) : Joseph C. Firey

It is certified that error appears in the above-identified patent and that said Letters Patent is hereby corrected as shown below:

Col. 12, line 27: insert a period after mechanism.
Col. 12, line 36: change period after chamber to a comma.
Col. 12, line 56: change period after valve to a comma.
Col. 12, line 57: change period after means to a comma.
Col. 12, line 60: insert a period after below.
Col. 13, line 4: change period after valve to a comma.
Col. 13, line 5: change period after source to a comma.
Col. 13, line 16: change period after valve to a comma.
Col. 13, line 19: change period after 50 to a comma.
Col. 13, line 21: insert a period after fuel.
Col. 13, line 27: insert a period after closed.
Col. 13, line 34: change period after connection to a comma.
Col. 13, line 59: change period after above to a comma.
Col. 14, line 60: change period after valve to a comma.
Col. 15, line 20: change period after means to a comma.

Signed and Sealed this

Twenty-seventh Day of October, 1992

*Attest:*

DOUGLAS B. COMER

*Attesting Officer*

*Acting Commissioner of Patents and Trademarks*